US008408434B2

(12) United States Patent
Sevastianov

(10) Patent No.: US 8,408,434 B2
(45) Date of Patent: Apr. 2, 2013

(54) CLOTHES HANGER

(76) Inventor: Andrei Aleksandrovich Sevastianov, Moscow (RU)

( * ) Notice: Subject to any disclaimer, the term of this patent is extended or adjusted under 35 U.S.C. 154(b) by 426 days.

(21) Appl. No.: 12/783,178

(22) Filed: May 19, 2010

(65) Prior Publication Data

US 2010/0270340 A1 Oct. 28, 2010

Related U.S. Application Data

(63) Continuation-in-part of application No. PCT/RU2008/000713, filed on Nov. 19, 2008.

(30) Foreign Application Priority Data

Nov. 20, 2007 (RU) ..... 2007142669

(51) Int. Cl.
*A41D 27/22* (2006.01)

(52) U.S. Cl. ..... 223/91; 223/96

(58) Field of Classification Search ..... 223/85, 223/88, 91, 95, 96
See application file for complete search history.

(56) References Cited

U.S. PATENT DOCUMENTS

| | | | | | |
|---|---|---|---|---|---|
| 541,293 | A | * | 6/1895 | Smith | 223/96 |
| 654,340 | A | * | 7/1900 | Bradway | 223/96 |
| 937,400 | A | * | 10/1909 | Willard | 223/96 |
| 975,509 | A | * | 11/1910 | Carroll | 223/91 |
| 1,955,205 | A | * | 4/1934 | Sevigny | 223/91 |
| 2,104,305 | A | | 3/1937 | Marble | |
| 2,394,879 | A | * | 2/1946 | Snook | 223/96 |
| 2,432,251 | A | * | 12/1947 | Riemann | 223/91 |
| 2,440,951 | A | * | 5/1948 | Hrachovina | 223/91 |
| 2,806,641 | A | * | 9/1957 | Rowe | 223/96 |
| 3,229,871 | A | * | 1/1966 | Capo | 223/91 |
| 3,402,866 | A | * | 9/1968 | Byrd | 223/91 |
| 3,411,680 | A | * | 11/1968 | Lundeen | 223/96 |
| 4,177,908 | A | * | 12/1979 | Batts et al. | 223/96 |
| 4,619,385 | A | | 10/1986 | Lessard | |
| 5,040,707 | A | | 8/1991 | Ayano et al. | |
| 5,775,554 | A | * | 7/1998 | Taylor | 223/96 |
| 6,260,747 | B1 | | 7/2001 | Iam | |

FOREIGN PATENT DOCUMENTS

| | | |
|---|---|---|
| DE | 4406477 | 8/1995 |
| FR | 2747902 | 10/1997 |
| GB | 658644 | 10/1951 |
| GB | 2372697 | 9/2002 |
| JP | 63169979 | 11/1988 |
| SU | 216940 | 1/1967 |

OTHER PUBLICATIONS

International Search Report dated Apr. 23, 2009 for International Application No. PCT/RU 2008/000713.

* cited by examiner

*Primary Examiner* — Nathan Durham
(74) *Attorney, Agent, or Firm* — Locke Lord LLP

(57) ABSTRACT

The invention discloses five embodiments of hangers for clothes having a first crossbar forming together with means for arranging the hanger on a support a main frame, which comprises an additional second crossbar having a free end for hanging trousers and capable of moving it in space into various positions relative to the main frame and its subsequent pressing to the first crossbar.

7 Claims, 9 Drawing Sheets

D – D

CLOTHES HANGER

CROSS-REFERENCE TO RELATED APPLICATIONS

This continuation-in-part application claims priority under §120 to PCT/RU2008/000713, filed on Nov. 19, 2008, designating the United States, and also claims priority under §119 to Russian Application No. 2007142669, filed Nov. 20, 2007, and of which the entire contents is incorporated herein by reference.

TECHNICAL FIELD

The invention relates to the light industry, to household goods, trade, consumer services and can be used for clothes placed in a hover at demonstration, storage, transportation and handling.

BACKGROUND

Much attention is now paid to development of various hangers for clothes of various types characterized by convenience in handling, variety in their art-design decisions, and making them of different materials.

Known in the art is a traditional design of a hanger made of different materials, containing a hook for suspending the hanger on a support, two shoulders forming a main frame, and a crossbar under the main frame, in which in contact with the clothes are two shoulders and the crossbar, a jacket being hung on the shoulders and unmentionables or other clothes being placed on the crossbar (JP, 63-169979/1988, UM). Thus, for placing trousers on a crossbar they must be dragged through the limited space above the crossbar that leads to their compression, loss of appearance, and many manipulations are necessary with them, preferably using both hands.

Known in the art is a device for hanging clothes including a jacket and trousers said device comprising a main frame having a top portion to be placed inside a jacket from shoulder to shoulder and a bottom portion located upright separately and extending in the direction of the top portion, said top portion having a vertical through hole in its center; an additional supporting frame having a top portion arranged between said top and bottom portions of the main frame, and a lower portion adapted for placing trousers thereon, in so doing said lower portion is placed vertically and separately from said top portion and is arranged under said lower portion of the main frame; a hook member having an end portion secured on said top portion of the main frame, and a vertical portion freely extending in said through hole with its other end protruding from the through hole and formed into a hook so that said main frame can move relative to the main frame between the lower position, in which a space between said lower portion of the main frame and said lower portion of the supporting frame is formed for a possibility of passing the trousers through it, and an top position in which said lower portion of said supporting frame engages the main frame for gripping the trousers hung on said lower portion of said main frame (U.S. Pat. No. 5,040,707, A).

However, in this design the movement of the lower portion of the supporting frame to the lower position necessary for placing the trousers thereon by dragging takes place immediately after releasing the hook when taking the device off, in the working position of the hook hung on the support, and when hanging the trousers the device should be laid on any flat plane, and for fixing the trousers one has to lift the device with the clothes hung thereon upwards by the hook.

Also known in the art is a hanger for clothes comprising: a first supporting bar having a first end and a second end; a second supporting bar having a first end and a second end; a rotary mechanism for engaging the first end of the second bar with the first end of the first bar, the second bar being capable of turning relative to the first bar; a detachable latch mechanism for fastening the second end of the second bar to the second end of the first bar, a restrictor isolated from the latch mechanism and protruding from one of said bars for restriction of movement of the bars towards each other, the second bar being placed from above and arranged in parallel to the first bar when both bars are in the fastening position; in so doing the first end of the first bar in the first supporting position is put forward to a normal thereto the first bar; the second bar is free for rotation in a plane normal to the first support portion, and the pin of the first support portion of the first bar determines a center of its rotation; the first end of the second bar has a hole for engaging the first support portion of the first bar at respective movement between them (U.S. Pat. No. 6,260,747, B1).

However, in so doing the trousers are disposed on the movable bar having an appropriate degree of freedom, and to hang the trousers thereon by one hand is inconvenient for the user. Besides, to press the trousers to the first supporting bar, one has to press the second bar with the clothes placed thereon, and the trousers pressed to the first bar are bent.

Also known in the art is a garment hanger (GB, 658644, B) comprising two similar plane-faced clamping strips hinged together at there ends so that the relative motion of the strips is in plane at right-angels to the said plane faces and so that the said faces may be brought together by initial simple pivoting movement of one strip with respect to other and by a small final clamping movement having a component longitudinally of the strips, and means for retaining the strips in the said clamped position. However, in so doing the trousers pressed to said plane faces become deformed.

The disadvantages of the hangers of the known designs are inconvenient threading of the trousers in the hanger, the absence of reliable fixing of the trousers excluding their sliding from the hanger. The known use of anti-slid materials put on the crossbar does not provide a guaranteed fixing of trousers thereon and makes it necessary to level the material of the trousers since at hanging they engage the anti-slid material. The use of foam rubber as an anti-slid material does not guarantee a long operation and, besides, the material itself is fragile and subject to rupture at intensive operation, for example in a trading network.

SUMMARY

One object of the invention is to develop a hanger for clothes convenient in use, providing a high quality of keeping the clothes due to reliable fixing of the clothes in particular trousers on the hanger both in its hung position and with the hanger placed on a plane.

This object has been attained by creating a first embodiment of the hanger for clothes comprising:

- a first frame formed with two arms adapted for hanging a jacket, and a first crossbar arranged below and between them;
- means for arranging the hanger on a support comprising a hook with a leg extending in a through hole between the arms of the first frame and capable of moving the first frame along the leg axis provided with a restrictor limiting the lower position of the leg;
- a second frame formed by said hook with a leg and rigidly secured to said leg of said hook by the second crossbar for hanging trousers and a second crossbar for trousers arranged in parallel to the first crossbar and capable of moving the second crossbar to its lower position in a plane of the first frame in parallel to the first crossbar and under it for a distance sufficient for such hanging and then forcing the second crossbar with the trousers placed thereon under the first crossbar, means for arranging the hanger on a support comprising a return device, which when pressed from above on said hook provides said movement of the second crossbar to its lower position or said pressing of the second crossbar under the first crossbar and a return the hook back in the absence of such a pressure, and provided with a restrictor limiting the top and lower positions of the hook leg, the second frame being made asymmetric, the second crossbar having a free end for hanging trousers.

According to the invention, it is expedient that the return device is made in the form of a spring having an upper stroke limiter secured to the leg and a lower stroke limiter secured in the first frame.

The target object has been also attained by creating a second embodiment of the hanger for clothes comprising:

a first frame formed with two arms adapted for hanging a jacket, and a first crossbar disposed below and between them;

means for arranging the hanger on a support comprising a hook with a leg secured between the main frame arms, the hanger comprises a second frame formed by said hook with a leg and rigidly secured to said leg of said hook by the second crossbar for hanging trousers and capable of deflecting the second crossbar from the main frame plane in parallel to the first crossbar in front of it for a distance sufficient for such hanging and then forcing the second crossbar with the clothes placed thereon to the first crossbar, the second frame being made asymmetric, the second crossbar having a free end for hanging trousers thereon, and the leg has a pivot pin normal thereto and secured in the first frame in parallel to the second and first crossbars.

The object in view has also been attained by creating a third embodiment of the hanger for clothes comprising:

a main frame formed with two arms adapted for hanging a jacket, and a first crossbar disposed below and between them;

means for arranging the hanger on a support;

a second crossbar having a free end for hanging trousers thereon and having another end arranged on the main frame and capable of rotating to provide deflection of the free end of the second crossbar from the first crossbar in a plane normal to the plane of the main frame at an angle sufficient for such hanging and then forcing the second crossbar with the trousers placed thereon to the first crossbar, the hanger comprises a detachable device for fixing the free end of the second crossbar on the first crossbar;

the second crossbar has a pivot pin rigidly connected with its other end and located on the main frame.

According to the invention, the hanger may have two said second crossbars, by one at each side of the main frame, and have a surface for placing information and commercial.

The object in view has also been attained by creating a fourth embodiment of the hanger for clothes comprising:

a main frame formed with two arms adapted for hanging a jacket, and a first crossbar disposed below and between them;

means for arranging the hanger on a support, the hanger comprises a second crossbar having a free end for hanging trousers thereon and another end rigidly secured on a pin arranged on the main frame, the hanger is provided with a mechanism for turning the second crossbar about said pin having a lever rigidly connected to the pin and, when pressed, provides deflection of the free end of the second crossbar under the first crossbar at an angle sufficient for such hanging or return of the lever to the initial position and pressing the second crossbar with the trousers placed thereon in the absence of such pressure, and the hanger comprises a detachable device for fixing the free end of the second crossbar on the first crossbar.

The object in view has also been attained by creating a hanger for clothes comprising:

a first crossbar;

means for arranging the hanger on a support secured in the first crossbar;

a second crossbar having a free end for hanging trousers thereon and an another end arranged on the first crossbar with the exception motion of a second crossbar along a first crossbar and capable of rotating about the pin located on the first crossbar and rigidly connected to its another end, the free end of the second crossbar to provide deflection from the first crossbar in a plane normal to the plane of the first crossbar at an angle sufficient for such hanging and then forcing the second crossbar with the trousers placed thereon to the first crossbar;

a detachable device for fixing the free end of the second crossbar on the first crossbar.

According to the invention, the hanger may have two second crossbars by one at each side of the first crossbar, and a surface for placing information and commercial.

According to the invention, it is possible that the first and second crossbars have recesses corresponding to the bulges on the seams on the trousers.

BRIEF DESCRIPTION OF THE DRAWINGS

The invention will be further described by way of example with reference to the accompanying drawings, in which.

Figure 1A:
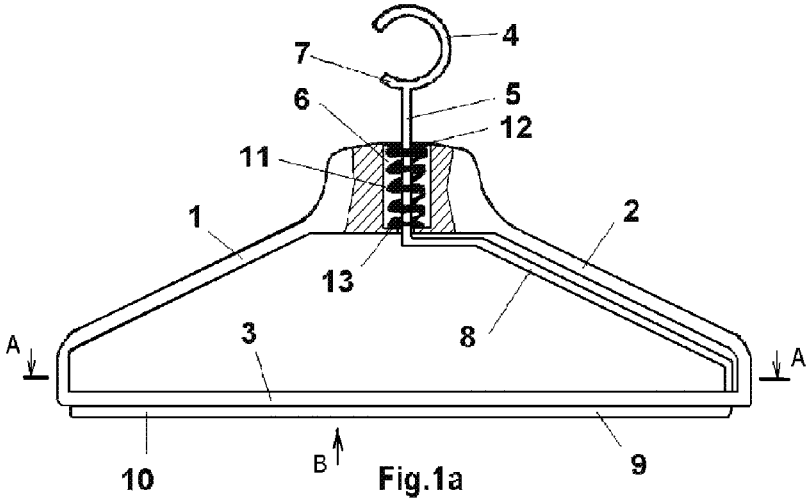
FIG. 1*a*, FIG. 1*b*, FIG. 1*c*, FIG. 1*d*, FIG. 1*e* illustrate the hanger according to the invention, embodiment 1.
Figure 1B:
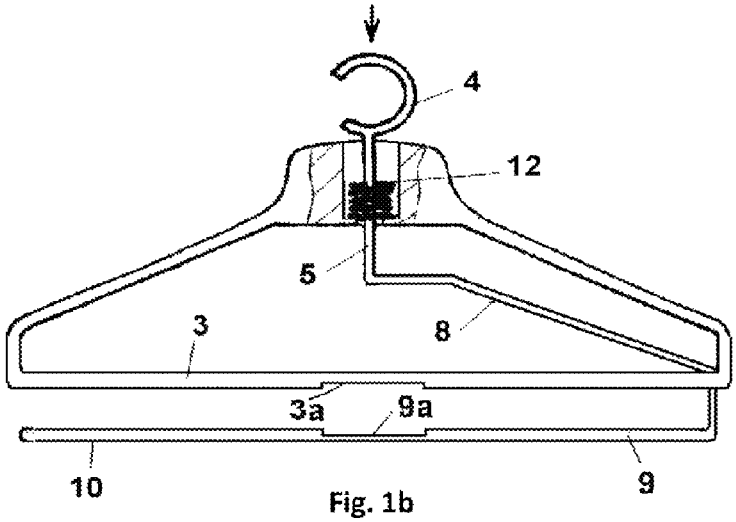
Figure 1C:
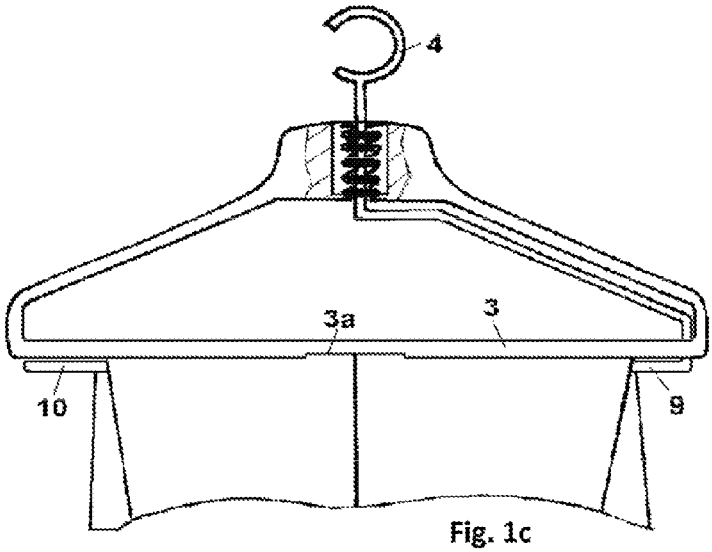
Figure 1D:
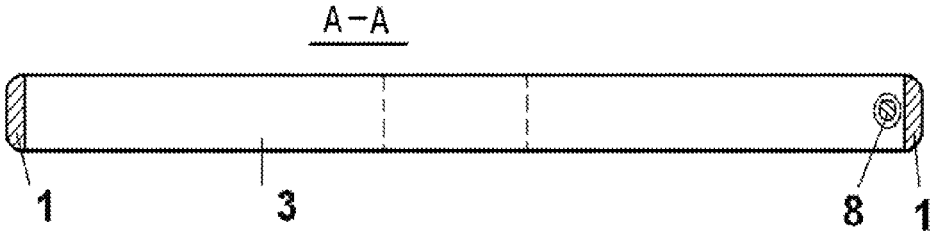
Figure 1E:
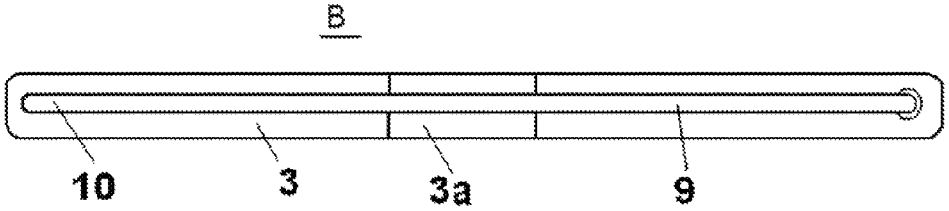
Figure 2A:
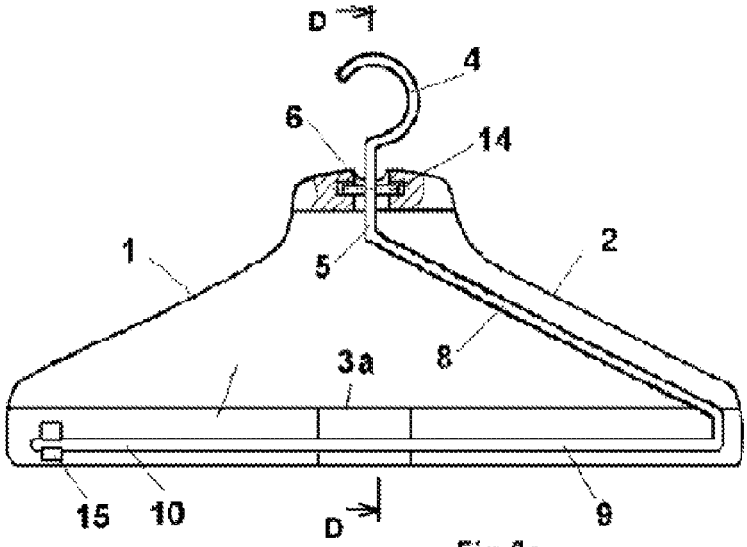
FIG. 2*a*, FIG. 2*b*, FIG. 2*c*, FIG. 2*d* illustrate the hanger according to the invention, embodiment 2.
Figure 2B:
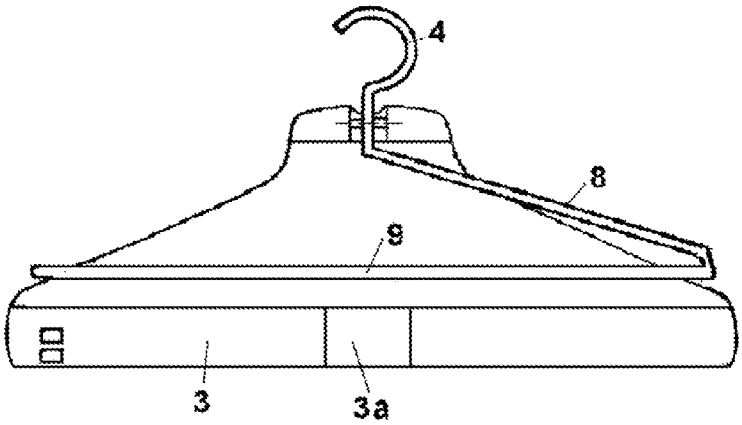
Figure 2C:
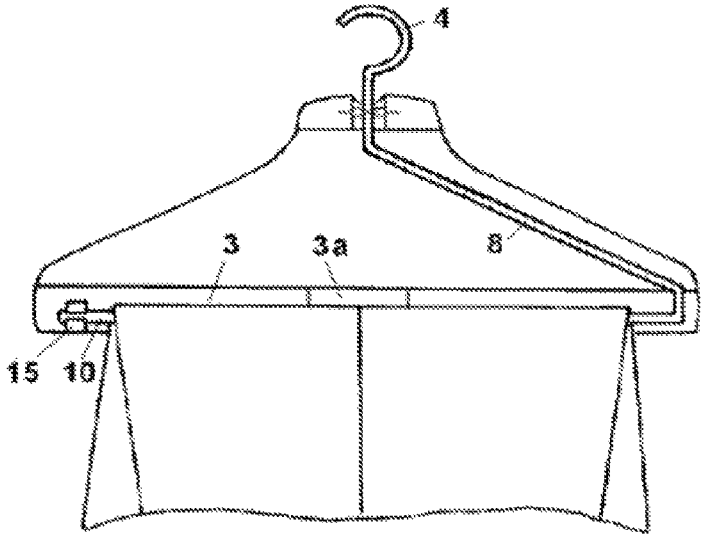
Figure 2D:
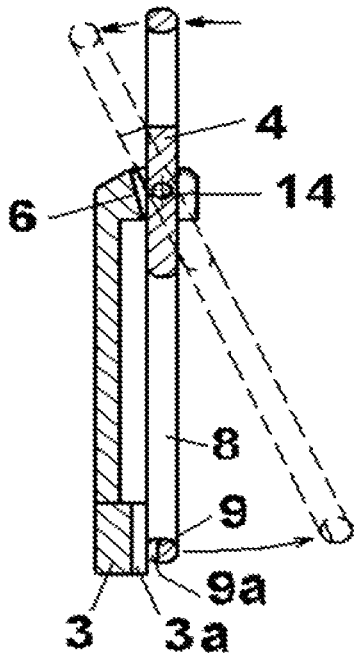

In this description the embodiments of the invention and the drawings do not limit the scope of realization of the invention and are within the claims of the invention.

DETAILED DESCRIPTION OF VARIOUS EMBODIMENTS

Shown in FIG. 1*a*, FIG. 1*b*, FIG. 1*c*, FIGS. 1*d* and 1*e* is the first embodiment of the hanger for clothes according to the invention comprising arms 1 and 2 for hanging a jacket thereon and a first crossbar 3 forming a first frame, means for arranging the hanger on a support comprising a hook 4 with a leg 5 extending in a through hole 6 of the first frame between the arms 1 and 2 of the first frame and capable of moving the first frame along the pin 6 of the leg, and the hook 4 is provided with restrictor limiting the lower position of the leg 5 made for example in the form of a projection 7 on the hook 4.

The leg 5 is rigidly connected, for example, by a rod 8 with the second crossbar 9 located in a space parallel to the first crossbar 3, and together forming a second asymmetric frame. The second crossbar 9 has a free end 10 adapted for hanging trousers.

In this design the first crossbar 3 is located perpendicularly to the pin of the leg 5 and has a longitudinal slot lying in a plane of the first frame whose sizes and configuration provide a possibility of moving through it a rod 8 of the second frame but prevents complete placing of the second crossbar 9 thereon.

For more reliable fixing of trousers on the crossbars 3 and 9, recesses 3*a* and 9*a* may be made corresponding to the bulges on the seams on the trousers.

The means for arranging the hanger on the support comprising a return device made in the form of a spring 11, extending in the through hole 6 around the leg 5 and having an upper stroke limiter 12 secured to the leg 5 and a lower stroke limiter 13 secured in the first frame. In the absence of trousers or other clothes on the second crossbar 9, the hook 4 and the leg 5 occupy the top position, in which case the second crossbar 9 is pressed along its while length to the first crossbar 3. Such a position of the hanger does not prevent its use for hanging a jacket on arms 1 and 2 and does not lead to disturbance of flatness of the hanger.

For hanging a pair of trousers the user should press the hook 4 from above and to move the leg 5 to its lower position and, respectively, move the second crossbar 9 downward under the first crossbar 3 for a distance sufficient for releasing the free end 10 from contact with the first crossbar 3. The hanging of trousers is carried out from the free end side that allows one to manipulate with the trousers with one hand, for example, by adjusting the position of the trousers on the second crossbar by controlling the force of pressing the second crossbar 9 to the first crossbar 3 while changing the force of pressure from above on the hook 4 what can be made with one hand holding the hook from above by the palm and placing the fingers in the space under the leg 5.

In the absence of pressure from above to said hook 4, the second crossbar with the trousers placed thereon and the hook 4 come back to the top position thereby pressing the trousers to the first crossbar. In so doing the presence of the trousers on the hanger does not interfere with the manipulations necessary for hanging a jacket.

The hanger for clothes made according to the first embodiment allows one to perform manipulations necessary for hanging of clothes under comfortable conditions for the user, both at vertical and at horizontal position of the hanger, and it is convenient in handling.

Presented in FIG. 2*a*, FIG. 2*b*, FIG. 2*c* and FIG. 2*d* is a second embodiment of the hanger for clothes according to the invention. The hanger comprising arms 1 and 2 for hanging a jacket thereon and a first crossbar 3 forming a first frame, as well as means for placing the hanger on a support comprising a hook 4 with a leg 5 extending in a through hole 6 of the first frame between the arms 1 and 2 of the first frame on a pivot pin 14 of the leg 5 normal thereto the pin of the leg 5.

The leg 5 is rigidly connected, for example through a rod 8, to the second crossbar 9 located in a space parallel to the first crossbar 3 and forming together a second asymmetric frame. The second crossbar 9 has a free end 10 adapted for hanging of trousers. In this case, the leg 5 is secured in the first frame on the pin 14 of rotation parallel to the second 9 and first 3 crossbars.

The hanger comprises a quickly detachable device 15 for fixings the free end 10 of the second crossbars 9 on the first crossbar 3 which can be made using any known method, for example, in the form of a magnetic latch or a spring latch. For more reliable fixing of trousers on the crossbars 3 and 9, recesses 3*a* and 9*a* may be made corresponding to the bulges on the seams on the trousers.

For hanging the trousers one should release the free end 10 from fastening on the first crossbar 3 pressing on the hook 4, to turn the leg 5 about the pin 14 and respectively to deflect the second crossbar 9 from the first crossbar 3 for a distance sufficient for releasing the free end 10 from contact with the first crossbar 3. The hanging of the trousers is effected at the side of the free end 10 that allows one to make manipulations with the trousers by one hand, for example, adjusting the position of the trousers on the second crossbar 9 by controlling the force of pressure of the second crossbar 9 to the first crossbar 3 while changing the angle of rotation of the leg 5.

The hanger for clothes made according to the second embodiment allows one to perform manipulations necessary for hanging the clothes under comfortable conditions for the user, both at vertical and at horizontal position of the hanger, that is convenient in handling.

Figure 3A:
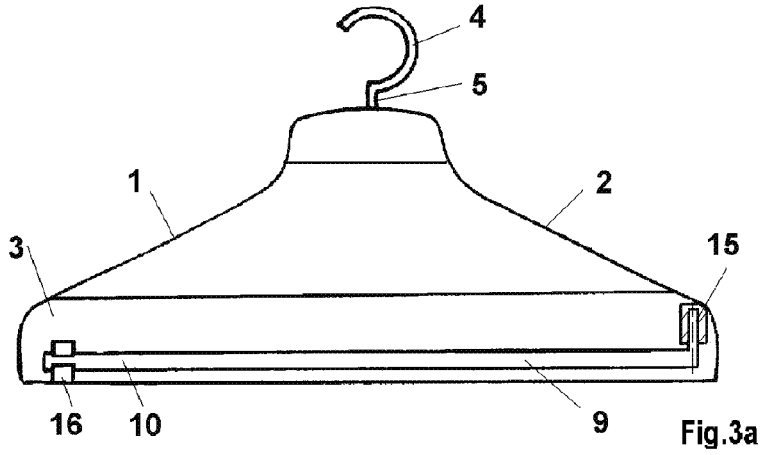
FIG. 3*a*, FIG. 3*b*, FIG. 3*c* illustrate the hanger according to the invention, embodiment 3.
Figure 3B:
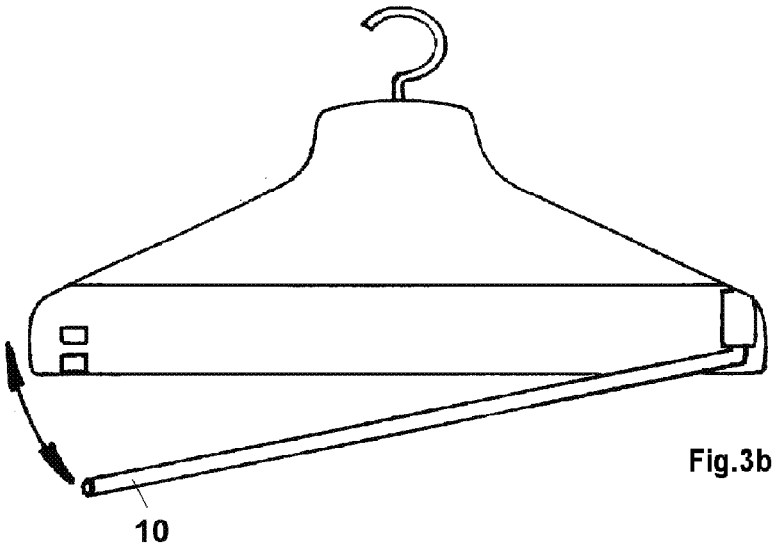
Figure 3C:
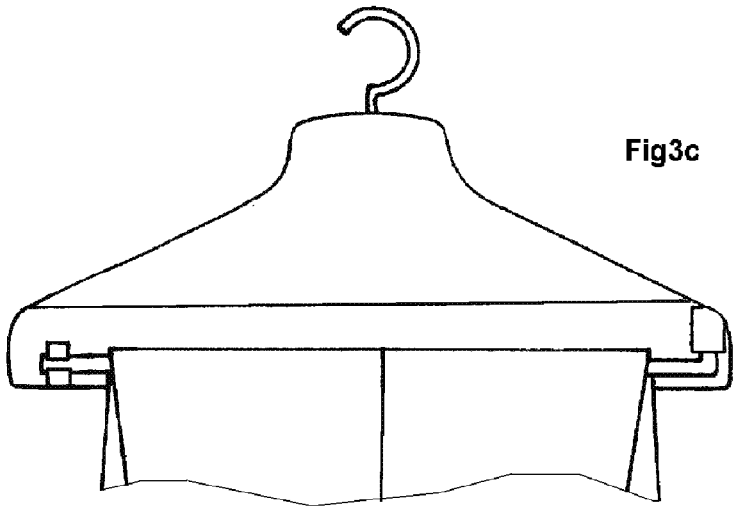
Figure 4A:
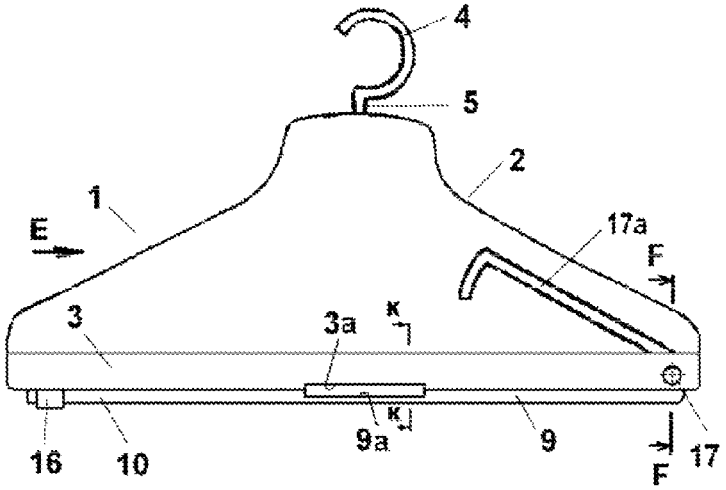
FIG. 4*a*, FIG. 4*b*, FIG. 4*c*, FIG. 4*d*, FIG. 4*e* illustrate the hanger according to the invention, embodiment 4.
Figure 4B:
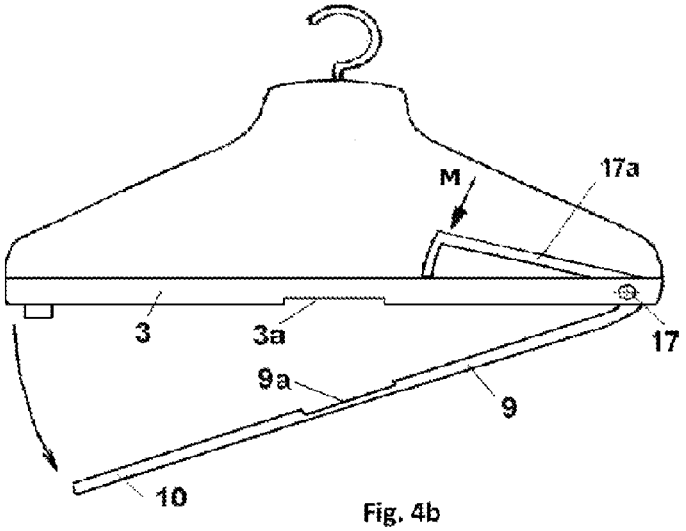
Figure 4C:
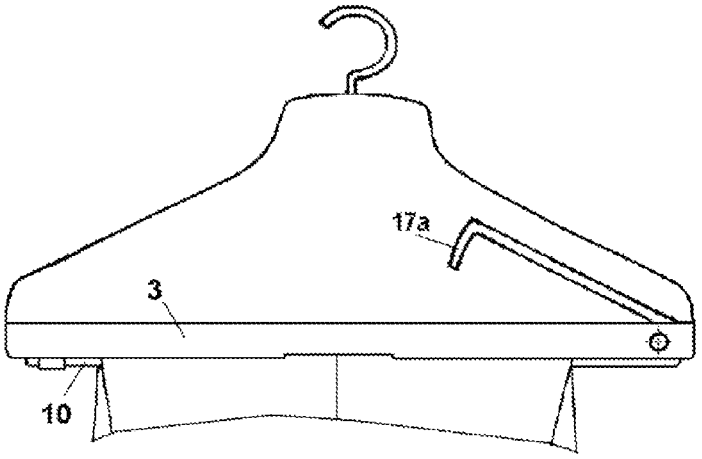
Figure 4D:
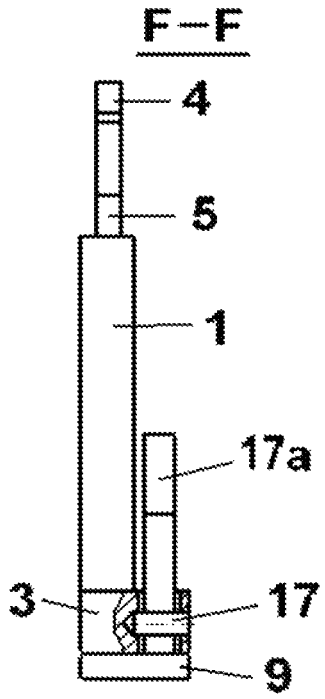
Figure 4E:
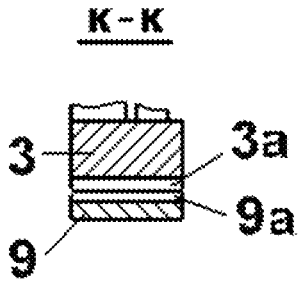

Shown in FIG. 3*a*, FIG. 3*b*, FIG. 3*c* is a third embodiment of the hanger for clothes according to the invention, said hanger comprising arms 1 and 2 for hanging a jacket thereon and a first crossbar 3 forming a main frame, as well as means for arranging the hanger on a support consisting of a hook 4 with a leg 5 secured between the arms 1 and 2 of the first frame.

The hanger comprises a second crossbar 9 which has a free end 10 adapted for hanging trousers. In this case, the other end of the second crossbar 9 is located on the main frame and rigidly connected to the pin 15 of rotation located on the main frame perpendicularly to the first 3 and second 9 crossbars.

The hanger has a quickly detachable device 16 for fixing the free end 10 of the second crossbars 9 on the first crossbar 3, which can be made according to any known method, for example, in the form of a magnetic latch or a spring latch. For more reliable fixing of the trousers, the crossbars 3 and 9 may have recesses corresponding to the thickenings on the seams of the trousers (not shown in the drawings).

For hanging the trousers, it is necessary to release the free end 10 of the fastening in the fixing device 16 on the first crossbar 3, to deflect the second crossbar 9 from the first crossbar 3 at an angle sufficient for releasing the free end 10 from contact with the first crossbar 3. The hanging of the trousers is effected at the side of the free end 10 that allows one to perform manipulations with the trousers by one hand, for example, by adjusting the position of the trousers on the second crossbar 9 through adjustment of the force of pressure on the second crossbar 9 to the first crossbar 3 while changing the angle of rotation of the second crossbar 9.

According to the invention, the claimed hanger may comprise two said second crossbars 9, by one at each side of the main frame, and the main frame may have a plane for placing information on that site that is convenient when the hanger is used in the clothing trade.

The hanger for clothes made according to its third embodiment allows one to perform manipulations necessary for hanging the clothes under comfortable conditions for the user, both at vertical and at horizontal position of the hanger, that is convenient in handling.

Shown in FIG. 4*a*, FIG. 4*b*, FIG. 4*c*, FIG. 4*d*, FIG. 4*e* is a fourth embodiment of the hanger for clothes according to the invention comprising arms 1 and 2 for hanging a jacket thereon and a first crossbar 3 forming a main frame, as well as means for arranging the hanger on a support consisting of a hook 4 with a leg 5 secured between the arms 1 and 2 of the first frame.

The hanger comprises a second crossbar 9 which has a free end 10 adapted for hanging trousers. In this case, the other end of the second crossbar 9 is located on the main frame and rigidly connected to the pivot pin 17 located on the main frame, for example, on the first crossbar.

The hanger is provided with a detachable mechanism for turning the second crossbar about said pivot pin 17 having a lever 17*a* rigidly connected to the pin and, when pressed, provides from above or from below corresponding deflection of the free end 10 of the second crossbars 9 under the first crossbar 3 through an angle sufficient for such hanging, or returning of the lever 17*a* to the initial position and pressing the second crossbar with the trousers placed thereon.

The hanger has a quickly detachable device 16 for fixing the free end 10 of the second crossbars 9 on the first crossbar 3 which can be made according to any known method, for example, in the form of a magnetic latch or a spring latch. For more reliable fixing of the trousers, the crossbars 3 and 9 may have recesses 3*a* and 9*a* corresponding to the thickenings on the seams of the trousers.

For hanging the trousers, it is necessary to release the free end 10 of the fastening in the fixing device 16 on the first crossbar 3, by pressing on the lever 17*a* from above or from below to deflect the second crossbar 9 from the first crossbar 3 at an angle sufficient for the trousers hanging on the second crossbar 9. The trousers hanging is effected at the side of the free end 10 that allows one to perform manipulations with the trousers by one hand, for example, by adjusting the position of the trousers on the second crossbar 9 through adjustment of the force of pressure on the second crossbar 9 to the first crossbar 3 while changing the angle of deflection of the second crossbar 9 with pressing on the lever 17*a* from above or from below.

According to the invention, the hanger may have two said second crossbars 9, by one at each side of the main frame, and the main frame may have a site for placing information on that site that is convenient when the hanger is used in the clothing trade The hanger for clothes made according to its fifth embodiment, allows one to perform manipulations necessary for hanging the clothes under comfortable conditions for the user, both at vertical and at horizontal position of the hanger that is convenient in handling.

Shown in FIG. 5*a*, FIG. 5*b*, FIG. 5*c*, FIG. 5*d*, FIG. 5*e* is a fifth embodiment of the hanger for clothes according to the invention.

In this case the hanger comprises a second crossbar 9 which has a free end 10 adapted for hanging trousers thereon and an another end arranged on the first crossbar 3 with the exception of motion a second crossbar 9 along a first crossbar 3 and capable of rotating about the pin 15 located on a first crossbar 3 and rigidly connected to it. The free end 10 of the second crossbar 9 is capable to provide deflection from the first crossbar 3 in a plane normal to the plane of the first crossbar 3 at an angle sufficient for such hanging and then forcing the second crossbar with the trousers placed thereon to the first crossbar 3.

For example, the free end 10 can be provided with a tip preventing movement of the trousers along the length of the second crossbar 9.

The hanger has a quickly detachable device 16 for fixing the free end 10 of the second crossbars 9 on the first crossbar 3 which can be made according to any known method, for example, in the form of a magnetic latch or a spring latch. For more reliable fixing of the trousers, the crossbars 3 and 9 may have recesses 18 corresponding to the thickenings on the seams of the trousers as shown in the drawings.

For hanging the trousers, it is necessary to release the free end 10 of the fastening in the fixing device 16 on the first crossbar 3, to deflect the second crossbar 9 from the first crossbar 3 at an angle sufficient for releasing the free end 10 from contact with the first crossbar 3. The trousers hanging is effected at the side of the free end 10 that allows one to perform manipulations with the trousers by one hand, for example, by adjusting the position of the trousers on the second crossbar 9 through adjustment of the force of pressure on the second crossbar 9 to the first crossbar 3 while changing the angle of rotation of the second crossbar 9.

According to the invention, the hanger may have two said second crossbars 9, by one at each side of the first crossbar, and a surface for placing information and commercial that is convenient when the hanger is used in the clothing trade.

Figure 5A:
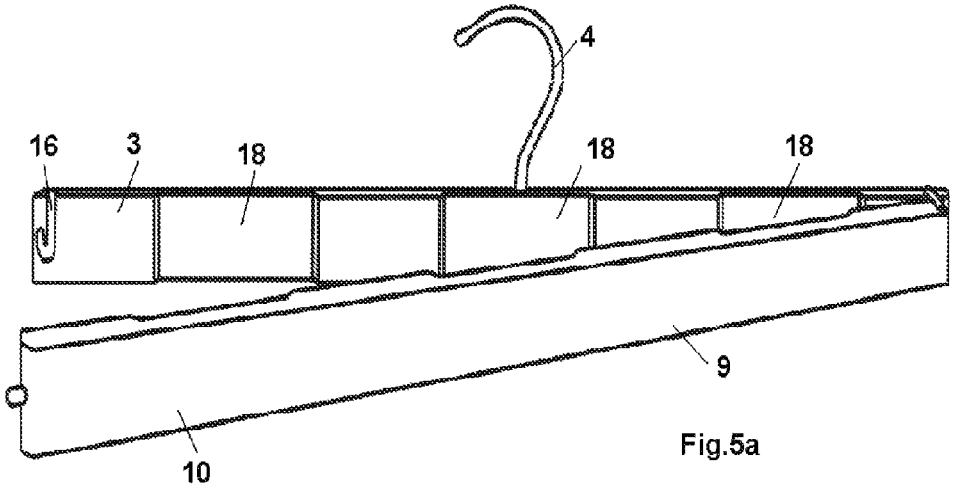
FIG. 5*a*, FIG. 5*b*, FIG. 5*c*, FIG. 5*d*, FIG. 5*e* illustrate the hanger according to the invention, embodiment 5.
Figure 5B:
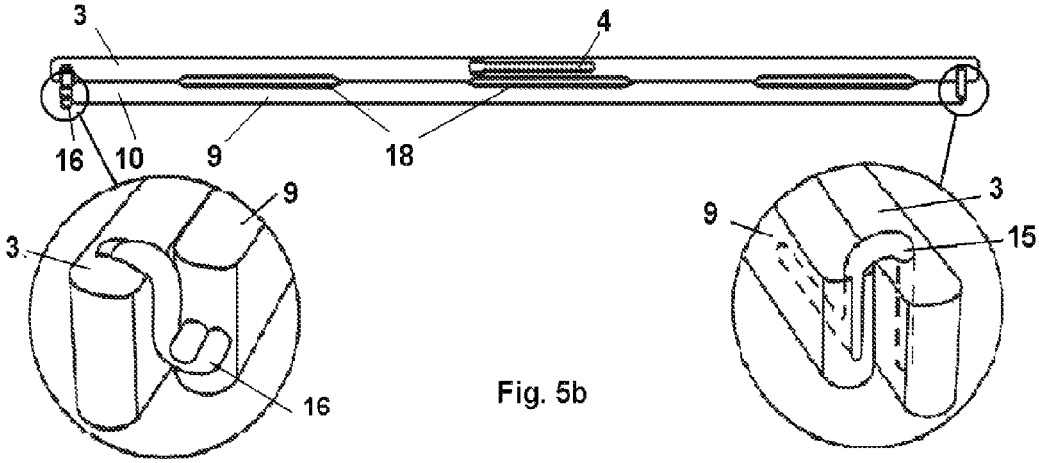
Figure 5C:
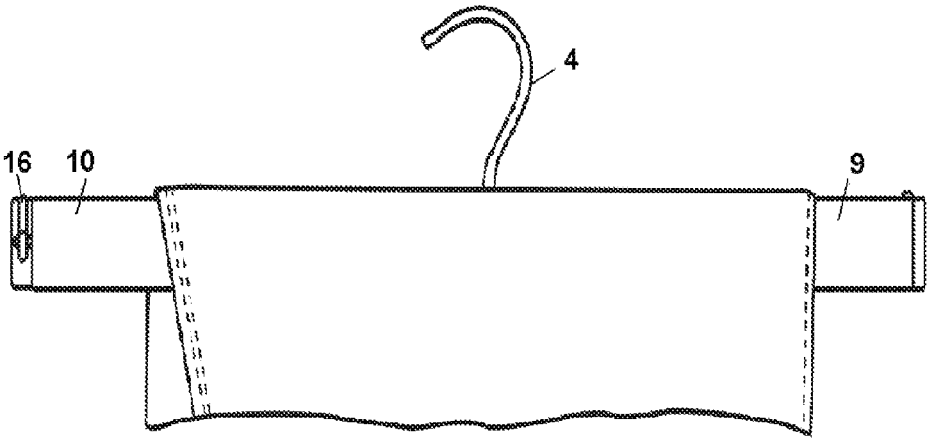
Figure 5D:
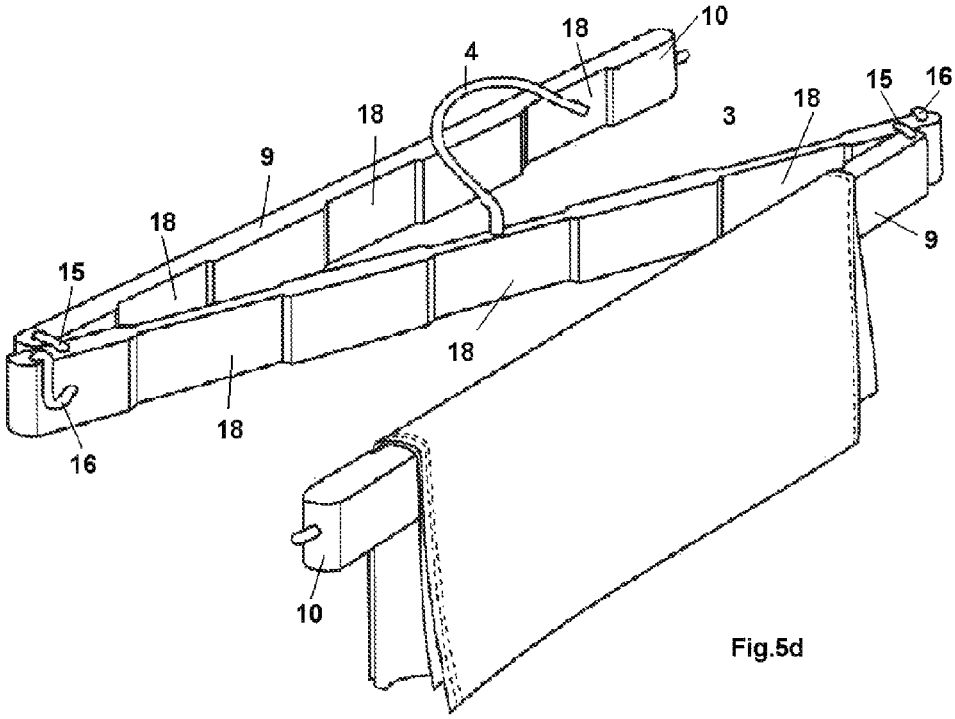
Figure 5E:
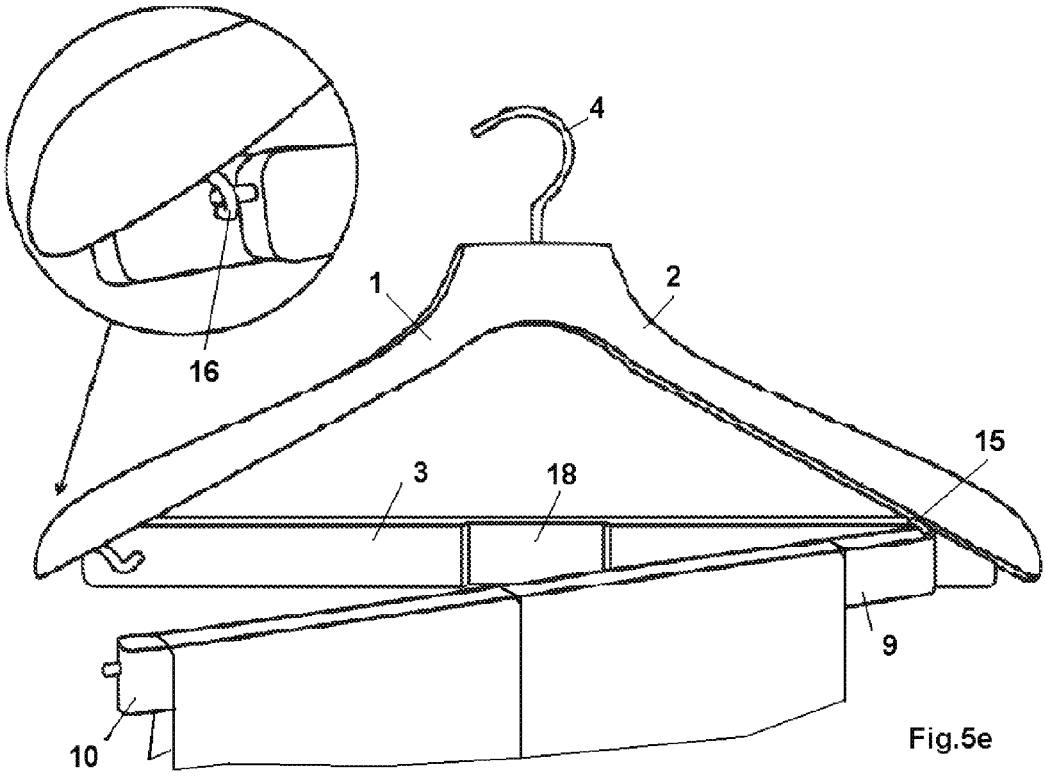

It is possible the hanger may have the arms 1 and 2 for hanging a jacket too (FIG. 5*e*).

The hanger for clothes, made according to its embodiment allows one to perform manipulations necessary for hanging the trousers under comfortable conditions for the user both at vertical and at horizontal position of the hanger, that is convenient in handling.

Experts in the design field understand that various modifications and improvements can be made in the design of the claimed hanger for clothes without departing beyond the scope of the invention. For example, modifications may be resulted from the field of application of the hanger, or the hangers are made according to a corporate style of the user and seller by using other devices for fixing, devices for turning the second crossbar, and due to other circumstances.

The hanger for clothes according to the embodiments of the invention can be made of various known materials and by well known methods. The hanger for clothes according to the invention meets the corresponding requirements on its operation under different conditions in everyday life, in industry, in trade and in other branches of a national economy.

What is claimed is:

1. A hanger for clothes comprising:

a first frame formed with two arms adapted for hanging a jacket, and a first crossbar arranged below and between them;

means for arranging the hanger on a support comprising a hook with a leg extending in a through hole between the arms of the first frame and capable of moving the first frame along the leg axis provided with a restrictor limiting the lower position of the leg;

a second frame formed by said hook with a leg and rigidly secured to said leg of said hook by the second crossbar for hanging trousers and a second crossbar for hanging trousers in parallel to the first crossbar and capable of moving the second crossbar to its lower position in a plane of the first frame in parallel to the first crossbar and under it for a distance sufficient for such hanging and then forcing the second crossbar with the trousers placed thereon under the first crossbar; and means for arranging the hanger on a support comprising a return device, which when pressed from above on said hook, provides movement of the second crossbar to its lower position or pressing of the second crossbar under the first crossbar and returns the hook back in the absence of such pressure, and provided with a restrictor limiting the top and lower positions of the hook leg, the second frame being made asymmetric, the second crossbar having a free end for hanging trousers.

2. The hanger of claim 1, wherein the return device is made in the form of a spring having an upper stroke limiter secured to the leg and a lower stroke limiter secured in the first frame.

3. The hanger of claim 1, wherein the first crossbar and the second crossbar have recesses corresponding to the bulges on the seams on the trousers.

4. A hanger for clothes comprising:

a first frame formed with two arms adapted for hanging a jacket, and a first crossbar disposed below and between them;

means for arranging the hanger on a support comprising a hook with a leg secured between the arms of the main frame;

a second frame formed by said hook with a leg and rigidly connected to said leg of said hook by the second crossbar for hanging trousers, and providing deflection of the second crossbar from the main frame plane in parallel to the first crossbar in front of it for a distance sufficient for such hanging with subsequent pressing the second crossbar with the clothes placed thereon to the first crossbar; and a detachable device for fixing the free end of the second crossbar on the first crossbar, the second frame being made asymmetric, the second crossbar having a free end for hanging trousers thereon, and the leg has a pivot pin normal thereto and secured in the first frame in parallel to the second and first crossbars.

5. The hanger of claim 4, wherein the first crossbar and the second crossbar have recesses corresponding to the bulges on the seams on the trousers.

6. A hanger for clothes comprising:

a main frame formed with two arms adapted for hanging a jacket, and a first crossbar disposed below and between them;

means for arranging the hanger on a support;

a second crossbar having a free end for hanging trousers thereon, and another end rigidly secured on a pin arranged on the main frame;

a mechanism for turning the second crossbar about said pin having a lever rigidly connected to the pin and, when pressed, provides deflection of the free end of the second crossbar under the first crossbar at an angle sufficient for such hanging, or return of the lever to the initial position and pressing the second crossbar with the trousers placed thereon in the absence of such pressure; and a detachable device for fixing the free end of the second crossbar on the first crossbar.

7. The hanger of claim 6, wherein the first crossbar and the second crossbar have recesses corresponding to the bulges on the seams on the trousers.

* * * * *